United States Patent [19]

Surkamp

[11] Patent Number: 4,776,372

[45] Date of Patent: Oct. 11, 1988

[54] DRIVE CONNECTION FOR CONTROLLING THE RECIPROCATION OF AN OPERATING MEMBER FROM A DRIVE SHAFT THROUGH AN ECCENTRIC MEMBER

[76] Inventor: Paul Surkamp, Auf dem Zanger 27, D-4152 Kempen, Fed. Rep. of Germany

[21] Appl. No.: 42,289

[22] Filed: Apr. 24, 1987

[30] Foreign Application Priority Data

Apr. 26, 1986 [DE] Fed. Rep. of Germany ..... 3614203

[51] Int. Cl.[4] ..... D03C 1/00

[52] U.S. Cl. ..... 139/76

[58] Field of Search ..... 139/66 R, 76; 74/126

[56] References Cited

U.S. PATENT DOCUMENTS 4,480,664 11/1984 Hohne et al. ..... 139/76
4,542,769 9/1985 Julich ..... 139/66 R
4,646,788 3/1987 Brock et al. ..... 139/76

FOREIGN PATENT DOCUMENTS 30930 2/1984 Japan ..... 139/76

*Primary Examiner*—Henry S. Jaudon
*Attorney, Agent, or Firm*—Shefte, Pinckney & Sawyer

[57] ABSTRACT

A drive connection for reciprocating a connecting rod from an intermittently rotating drive shaft through an eccentric member to manipulate a harness frame of a textile loom from one shedding position to another, includes a drive ring fixed to the drive shaft and a pawl pivotably mounted on the eccentric member for movement into and out of engagement in opposed recesses in the drive ring during dwells in the intermittent shaft rotation to connect or disconnect the eccentric member and the drive ring. The pawl is biased toward engagement in the recesses with opposed shifting levers being provided for actuating selective disengagement of the pawl from the recesses. A pivotable blocking device enables alternate engagement of the switching levers into pawl disengaging position. A pair of cam lobes formed on the drive ring for integral rotation with the drive shaft operate on the switching levers to permit intermittent shifting of the blocking device between blocking and non-blocking positions with respect to the shifting levers in precisely timed relation to the drive shaft rotation.

10 Claims, 1 Drawing Sheet

DRIVE CONNECTION FOR CONTROLLING THE RECIPROCATION OF AN OPERATING MEMBER FROM A DRIVE SHAFT THROUGH AN ECCENTRIC MEMBER

BACKGROUND OF THE INVENTION

The present invention relates generally to a drive connection for controlling the reciprocation of an operating member from a drive shaft through an eccentric member and, more particularly, to such a drive connection wherein intermittent rotation of the drive shaft is selectively transmitted through the eccentric member into reciprocation of a connecting rod operatively associated with a harness frame of a textile loom or a like operating member.

Improvements in textile looms have been directed to increasing the rate of production with enhanced quality. This requires high speed operation with reliable mechanical performance. These desired characteristics are not easily attainable because of the problems encountered in attempting to operate reciprocating mechanisms, such as the harness frames in a textile weaving loom, that must reciprocate at high speeds yet stop accurately for proper operational positioning. As operating speeds of looms have increased, the problem of reliable control and positioning of harness frames has become of considerable concern.

It is therefore a principal object of the present invention to provide a drive connection capable of high speed reciprocation and reliable positioning control.

SUMMARY OF THE INVENTION

Briefly described, the drive connection of the present invention controls the reciprocation of an operating member, such as a harness frame of a textile loom, by selectively transmitting intermittent rotation of a drive shaft through an eccentric member into reciprocation of a connecting rod operatively associated with the harness frame or other operating member. The drive connection includes an annular drive ring fixed on the drive shaft and having a recess formed therein. A pawl is pivotably mounted on the eccentric member for engagement in and disengagement from the recess for selective drive connection and disconnection of the eccentric member to the drive ring. Pawl locking means are provided for releasably locking the pawl in engagement in the recess for driving connection of the drive ring to the eccentric member. Actuating means are engagable with the pawl for overcoming the pawl locking means to disengage the pawl from the recess and thereby disconnect the eccentric member from the drive ring. Blocking a means control the operation of the actuating means according to a predetermined program, the blocking means being mounted for selective movement according to the program between a blocking position and a non-blocking position. In the blocking position, the blocking means engages the actuating means for positioning the actuating means in engagement with the pawl to overcome the pawl locking means for releasing the pawl from locking engagement in the recess, thereby disconnecting the eccentric member from the drive ring to stop reciprocation of the connecting rod. In the non-blocking position, the blocking means is out of engagement with the actuating means to prevent the actuating means from engagement with the pawl to permit pawl locking operation of the pawl locking means, thereby establishing driving connection between the drive ring and the eccentric member for reciprocation of the connecting rod. Cam means are fixed for rotation with the drive shaft for engagement with and disengagement from the actuating means at a predetermined position during the rotation of the drive shaft for preventing switching of the blocking means between the blocking and non-blocking positions except at predetermined times during the rotation of the drive shaft.

In the preferred embodiment, the actuating means includes a pair of switching levers movably disposed at diametrically opposed locations adjacent the drive ring for engagement with the pawl. Biasing means urge each of the switching levers toward the drive ring. The cam means includes a pair of switching cams formed on the drive ring for engaging the switching levers during rotation of the drive shaft for moving the switching levers away from the drive ring. The cam means further includes a pair of pivot levers respectively located intermediate the switching cams and the switching levers. The switching cams and pivot levers are disposed in one plane of operation while the pawl is disposed in another plane of operation, with the switching levers being disposed in each plane to be acted upon by the switching cams and the pivot levers in the one plane and for acting upon the pawl in the other plane. Stop means is provided for limiting the degree of movement of the pivot levers toward the drive ring. Preferably, the switching levers are pivotably supported on a mounting rod by a slotted connection permitting a limited degree of non-pivoting translatory movement of the switching levers toward and away from the drive ring.

The blocking means is preferably arranged for disposition alternately in blocking position with respect to one of the switching levers while in non-blocking position with respect to the other of the switching levers. For this purpose, the blocking means in the preferred embodiment includes a rocker bar mounted pivotably with respect to the switching levers for movment according to the program to position opposite stop ends of the bar alternately in the blocking position respectively in relation to the switching levers. Biasing means are provided for urging the rocker bar into one of the blocking and non-blocking positions. A movable arm is provided for selectively pivoting the rocker bar against the biasing means at least approximately into the other of the blocking positions according to the program. Electromagnetically actuated control means, including a ferromagnetic armature on the rocker bar and a selectively actuable electromagnet disposed adjacent the scale beam, is provided for attracting the armature to shift and hold the rocker bar in such other position.

DETAILED DESCRIPTION OF THE PREFERRED EMBODIMENT

Figure 1:
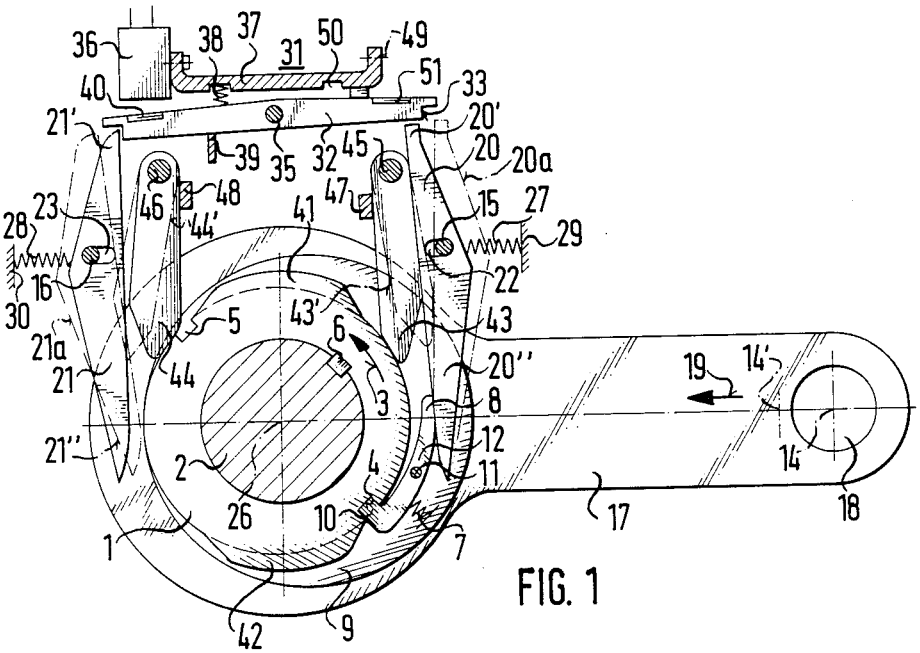
FIG. 1 is a side elevational view of a drive connection according to the preferred embodiment of the present invention.
Figure 2:
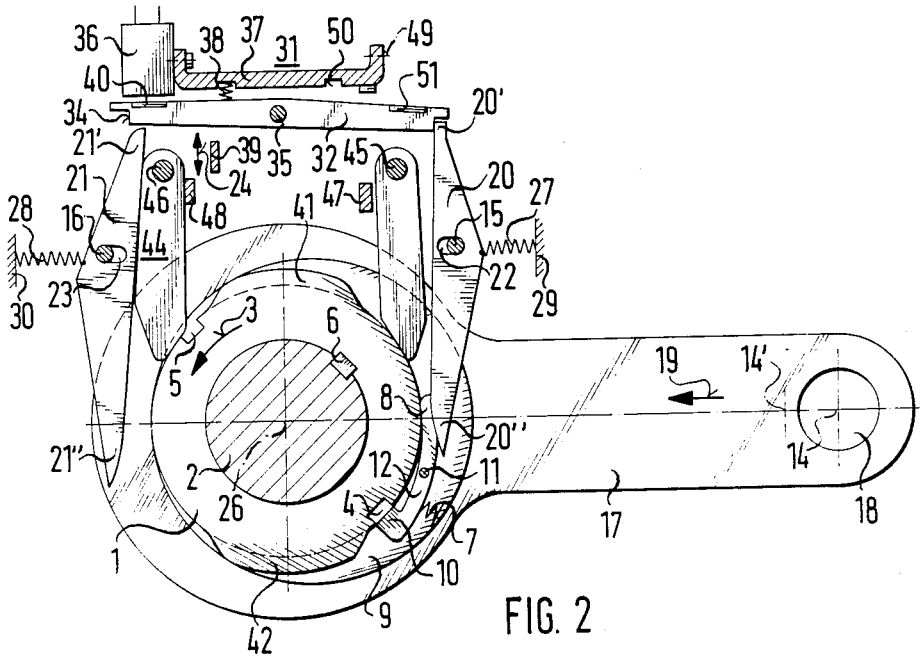
FIG. 2 is another side elevational view of the preferred drive connection of FIG. 1, shown in a different operating disposition.

Referring now to the accompanying drawings, the drive connection of the present invention is illustrated in FIGS. 1 and 2 as preferably embodied in a textile loom for controlling the manipulation of a harness frame between opposite shedding positions. The drive connection includes an annular drive ring 1 fixed on a drive shaft 2 by a key 6. The drive ring 1 has a pair of diametrically opposed recess 4 and 5 formed in its outer surface. In a conventional manner, the drive shaft 2 is intermittently rotated by suitable means (not shown) in 180 degree increments in the rotational direction of the arrow 3. After each incremental intermittent rotation, the drive shaft 2 dwells for a brief predetermined length of time before the next incremental 180 degree rotation occurs. As will be understood, a conventional textile loom will include a plurality of harness frames requiring shedding reciprocation and, accordingly, a plurality of the present drive connections will be provided along the length of the drive shaft 2 for separately controlling the manipulation of each harness frame.

An eccentric ring member 9 is rotatably mounted on the drive ring 1 eccentrically with respect to the rotational axis of the shaft 2 by a conventional covered roller bearing arrangement (not shown) which is concentric with respect to the shaft 2. An elongate rocker pawl 12 is pivotably mounted approximately midway along its length on a stud 11 projecting from the face of the eccentric member 9 for pivotal movement of a nose portion 10 at one end of the pawl 12 into and out of engagement in the drive ring recesses 4 and 5. A spring 7 is mounted to the eccentric member 9 for constantly urging the nose portion 10 of the rocker pawl12 toward the drive ring 1 to bias the pawl 12 into engagement in the recesses 4 and 5. Thus, as will be understood, when the nose portion 10 of the pawl 12 is engaged in one of the recesses 4,5 of the drive ring 1, the eccentric member 9 is drivingly coupled with the drive ring 1 and, in turn, with the drive shaft 2 for eccentric rotation unitarily therewith. The eccentric member 9 is also rotatably mounted by another roller bearing arrangement (also not shown) to a connecting rod 17 which is connected to the afore-mentioned harness frame (not shown) by a shaft or other suitable connection 18 at the projecting end of the connecting rod. Thus, eccentric rotation of the eccentric member 9 as afore-described produces longitudinal reciprocation of the connecting rod 17 in a direction parallel to the arrow 19 to reciprocate the end 18 of the connecting rod 17 between points 14 and 14' and, in turn to shift the harness frame from one shed position to the other. Such reciprocation of the connecting rod 17 and, in turn, the harness frame continues intermittently with a brief dwell time as above-mentioned between each reciprocal movement for so long as the pawl 12 remains in engagement in one of the recesses 4,5 in the drive ring 1. Notably, at the completion of each reciprocal movement, the drive ring 1, the eccentric member 9, and the connecting rod 17 and its connecting end 18 are disposed in a dead-center position during each dwell period. As a result, forces acting on the connecting rod 17 at its connecting end 18 are transmitted either directly to or directly away from the central axis 26 of the drive shaft 2 so that little tendency exists for these components of the present drive connection to unintentionally move out of the dead-center position.

Selective pivoting manipulation of the rocker pawl 12 to disengage its nose portion 10 from the recess 4 or 5 is controlled by a pair of switching levers 20,21 positioned in diametrical opposition to one another at opposite sides of the drive ring 1. The switching levers 20,21 are movably mounted approximately midway along their length on stationary longitudinally extending support rods 15,16 which are received in slightly elongated slots 22,23 in the levers 20,21 to enable both pivotal and translatory movement of the switching levers 20,21 toward and away from the drive ring 1 as well as each other. A pair of springs 27,28 extend between respective stop surfaces 29,30 on the loom frame and the switching levers 20,21 to bias the levers 20,21 toward the drive ring 1 and each other. In this manner, each of the switching levers 20,21 is capable of movement with respect to its supporting rod 15,16 to move its operating end 20",21" toward the drive ring 1 to be positioned to contact the control end 8 of the rocker pawl 12 during rotation of the drive shaft 2 to pivot the nose portion 10 against the biasing force of spring 7 away from the drive ring 1 out of engagement in the recess 4 or 5, as illustrated by the switching lever 20 in FIG. 2, and alternatively to move the operating end 20",21" away from the drive ring 1 to be out of pawl disengaging contact with the operating end 8 during rotation of the drive shaft 2 to enable the spring 7 to maintain engagement between the nose portion 10 of the pawl 12 and the recess 4 or 5, as illustrated by the switching lever 20 in FIG. 1, all as more fully described hereinafter.

Blocking means, such as the blocking device indicated generally at 31, is provided for controlling the positioning of the switching levers 20,21 with respect to the drive ring 1 to control the positioning of the rocker pawl 12, all in accordance with a predetermined program operating on the blocking device 31 as hereinafter described for causing the loom to produce a textile fabric of a desired pattern. The blocking device 31 includes a rocker bar 32 pivotably mounted on a longitudinal support rod 35 fixed to the loom frame so that the rocker bar 32 extends generally transversely between the control ends 20',21' of the switching levers 20,21. The opposite ends of the rocker bar 32 are formed with a recessed step-like profile at 33,34 to provide stops for engagement respectively with the control ends 20',21' of the switching levers 20,21. More specifically, the pivotal mounting of the rocker bar 32 enables it to rock between a first position wherein the stop 34 is pivoted toward the switching lever 21 for blocking engagement with its control end 21' while the stop 33 is pivoted away from the switching lever 20 to be out of blocking engagement with its control end 20', as shown in FIG. 1, and a second opposite position wherein the stop 34 is pivoted away from and out of blocking engagement with the control end 21' of the switching lever 21 while the stop 33 is pivoted toward and into blocking engagement with the control end 20' of the switching lever 20. As will be seen in FIGS. 1 and 2, when either switching lever 20,21 is blocked as described by the rocker bar 32, the operating end 20",21" of the blocked lever 20,21 is moved toward the drive ring 21 for disengaging contact with the rocker pawl 12, as shown by switching lever 20 in FIG. 2 and switching lever 21 in FIG. 1, while at the same time the operating end 20",21" of the other unblocked switching lever 20,21 is moved away from the drive ring 1 under the influence of its biasing spring 27,28 to be out of position for disengaging contact with the rocker pawl 12, as represented by switching lever 20 in FIG. 1 and switching lever 21 in FIG. 2.

The rocker bar 32 of the blocking device 31 is normally biased into the first above-described position of FIG. 1 by a spring 38 acting between one end of the rocker bar and a carrier bracket 37 fixed to the loom frame. A movable arm 39 is positioned on the opposite side of the rocker bar 32 for movement toward and away from the rocker bar 32 in the directions indicated by arrow 34, such movement of the arm 39 being controlled in a conventional manner according to the desired pattern program of the loom for pivoting the rocker bar 32 against the biasing force of the spring 38 at least approximately into the second above-described position of FIG. 2. An electromagnet 36 is also mounted to the carrier bracket 37 adjacent the same end of the rocker 32 as the spring 38 for selective energization to magnetically attract and hold an armature 40 of ferromagnetic material affixed to the facing surface of the rocker bar 32 for positioning and holding the rocker bar in the position of FIG. 2. Energization and de-energization of the electromagnet 36 is also controlled by conventional means (not shown) according to the pattern program for the loom.

Notably, as will be recognized from the illustrations of FIGS. 1 and 2, the biasing springs 27,28 of the switching levers 20,21 act in each position of the rocker bar 32 to dispose the control end 20',21' of the nonblocked switching lever 20,21 immediately beneath the rocker bar 32 so that, unless moved, the nonblocked switching lever 20,21 prevents shifting of the rocker bar 32 between its two pivoting positions. The afore-mentioned capability of the switching levers 20,21 for pivoting and translatory movement simultaneously away from one another enables selective shifting of the rocker bar 32 between its two described positions, with a pair of switching cams 41,42 and a pair of pivot levers 43,44 being provided to so move the switching levers 20,21 intermittently away from one another in timed relation to the intermittent rotation of the drive shaft 2. The switching cams 41,42 are formed as lobes projecting from the outer periphery of the drive ring 1 in diametrical opposition to one another immediately following the recesses 4,5 relative to the direction of rotation of the drive ring 1, as indicated by arrow 3. The pivot levers 43,44 are pivotably supported on stationary longitudinally extending support rods 45,46 immediately adjacent the switching levers 20,21 with the free ends of the pivot levers 43,44 extending alongside the switching levers 20,21 toward the drive ring 1 into following relation with the switching cams 41,42 thereon. A pair of stops 47,48 fixed to the loom frame limit the possible pivotal movement of the pivot levers 43,44 toward the drive ring 1 so as to permit contact of the pivot levers 43,44 with only the switching cams 41,42 while maintaining the pivot levers 43,44 out of contact with the drive ring 1 itself, although as will be understood it is not possible to illustrate in the accompanying drawings the minimal spacing between the pivot levers 43,44 and the drive ring 1.

It is to be noted that the switching cams 41, 42 and the pivot levers 43,44 are disposed in a different plane of operation from the rocker pawl 12. The pivot levers 43,44 and the switching cams 41,42 as seen in the drawings of FIGS. 1 and 2 are nearer the observer than the coupling element 12, whereby the switching cams 41,42 and the rocker pawl 12 do not engage or otherwise interfere with one another during the rotational operation of the drive conection. The switching levers 20,21, on the other hand, as above-described, must operate in association with both the rocker pawl 12 and the pivot levers 43,44. Accordingly, the switching levers 20,21 are configured and positioned so that their operating ends 20",21" are located in the same plane of operation as the rocker pawl 12, while also extending through the same plane of operation as the pivot levers 43,44.

As will thus be understood, as the drive shaft 2 and the drive ring 1 intermittently rotate as above-described from the dead-center position shown in FIGS. 1 and 2, the cam lobe 41 initially engages the pivot lever 44 to induce pivotal movement thereof in a clockwise direction radially outwardly away from the drive ring 1 into position 44' shown in broken lines in FIG. 1. In such position, the pivot lever 44 also induces pivotal movement of the switching lever 21 away from the pivot lever 44 into a position **21*a* shown in broken lines in FIG. 1, wherein notably the control end 21' of the switching lever 21 is disposed outwardly beyond the corresponding end of the rocker bar 32. As the drive shaft 22 continues this 180 degree increment of movement, the cam lobe 42 of the drive ring 1 subsequently engages the pivot lever 43 to pivot it in a counterclockwise direction radially outwardly away from the drive ring 1 into position 43' shown in broken lines in FIG. 1, wherein the pivot lever 43 engages the pivots the corresponding switching lever 20 outwardly into a position 20*a* to position its control end 20' outwardly beyond the respective end of the rocker bar 32. As will be understood, whenever either of the switching levers 20,21 are held under the pivotal influence of the pivot levers 43,44, the rocker bar 32 may be pivoted as above-described into blocking disposition with respect to the outwardly held switching lever 20,21. As will be recognized from the drawings each of the switching cams 41,42 occupies a sufficient circumferential extent of the cam ring 1 that the cam lobes 41,42 will simultaneously act on the pivot levers 43,44 during at least a portion of the rotational movement of the drive shaft 2, during which the rocker bar 32** may be most easily and advantageously shifted.

Thus, throughout the intermittent rotation of the drive shaft 2 and drive ring 1, the cam lobes 41,42 in conjunction with the associated pivot levers 43,44 operate to intermittently pivot the switching levers 20,21 toward and away from one another in timed relation to the rotational cycle of the drive shaft 2 for enabling shifting of the rocker bar 32 of the blocking device 31, as desired, during each 180 degree incremental movement of the drive shaft 2. Accordingly, the shifting of the blocking device 31 may be controlled according to a predetermined program through selective actuation and de-actuation of the movable arm 39 and corresponding energization and de-energization of the electromagnet 36 to control reciprocation of the connecting rod 17 and its associated harness frame of the textile loom to enable production of textile fabric according to any desired pattern. Importantly, since the switching cams 41,42 are fixed to rotate with the drive shaft in accordance with the present invention, the control of the rocker pawl 12 to control, in turn, connection and disconnection of the drive ring 1 and eccentric member 9 necessarily occurs in desired synchronism with the rotation of the drive shaft 2 to avoid any manipulation of the harness frame out of timed cycle with other loom motions and functions.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A drive connection for controlling the reciprocation of an operating member, such as a harness frame of a textile loom, by selectively transmitting intermittent rotation of a drive shaft through an eccentric member into reciprocation of a connecting rod operatively associated with the operating member, said drive connection comprising an annular drive ring fixed on the drive shaft and having a recess formed therein, a pawl pivotably mounted on the eccentric member for engagement in and disengagement from said recess for selective drive connection and disconnection of said eccentric member to said drive ring, pawl locking means for releasably locking said pawl in engagement in said recess for driving connection of said drive ring to said eccentric member, actuating means engageable with said pawl for overcoming said pawl locking means to disengage said pawl from said recess and thereby disconnect said eccentric member from said drive ring, blocking means for controlling operation of said actuating means according to a predetermined program, said blocking means being mounted for selective movement according to said program between a blocking position in engagement with said actuating means for positioning said actuating means in engagement with said pawl to overcome said pawl locking means for releasing said pawl from locking engagement in said recess thereby disconnecting said eccentric member from said drive ring to stop reciprocation of said connecting rod and a non-blocking position out of engagement with said actuating means to prevent said actuating means for engagement with said pawl to permit pawl locking operation of said pawl locking means thereby establishing driving connection between said drive ring and said eccentric member for reciprocation of said connecting rod, and cam means fixed for rotation with the drive shaft for engagement with and disengagement from said actuating means at a predetermined position during the rotation of the drive shaft for preventing switching of said blocking means between said blocking and non-blocking positions except at predetermined times during the rotation of the drive shaft.

2. A drive connection according to claim 1 and characterized further in that said cam means is formed on said drive ring.

3. A drive connection according to claim 1 and characterized further in that said actuating means includes a pair of switching levers movably disposed at diametrically opposed locations adjacent said drive ring for engagement with said pawl, means for biasing each of said switching levers toward said drive ring, said cam means including a pair of switching cams arranged for engaging said switching levers during rotation of the drive shaft for moving said switching levers away from said drive ring, said blocking means being arranged for disposition alternately in blocking position with respect to one of said switching levers while in non-blocking position with respect to the other of said switching levers.

4. A drive connection according to claim 3 and characterized further in that said switching cams are formed on said drive ring.

5. A drive connecting according to claim 3 and characterized further in that each of said switching levers is pivotably supported on amounting rod by a slotted connection permitting a limited degree of non-pivoting translatory movement of said switching levers toward and away from said drive ring.

6. A drive connection according to claim 3 and characterized further in that said cam means includes a pair of pivot levers respectively located intermediate said switching cams and said switching levers, said switching cams and said pivot levers being disposed in one plane of operation and said pawl being disposed in another plane of operation with said switching levers being disposed in each said plane to be acted upon by said switching cams and said pivot levers in said one plane and for acting upon said pawl in said another plane.

7. A drive connection according to claim 6 and characterized further by stop means for limiting the degree of movement of said pivot levers toward said drive ring.

8. A drive connection according to claim 3 and characterized further in that said blocking means includes a rocker bar mounted pivotably with respect to said switching levers for movement according to said program to position opposite stop ends of said bar alternately in said blocking position respectively in relation to said switching levers.

9. A drive connection according to claim 8 and characterized further in that said blocking means includes biasing means for urging said rocker bar into one of said blocking and on-blocking positions.

10. A drive connection according to claim 9 and characterized further in that said blocking means includes a movable arm for selectively pivoting said rocker bar against said biasing means at least approximately into the other of said blocking and non-blocking positions according to said program, and electromagnetically actuated control means comprising a ferromagnetic armature on said rocker bar and a selectively actuable electromagnet disposed adjacent said rocker bar for attracting said armature to shift and hold said rocker bar in said other position.

* * * * *